US010435259B2

(12) United States Patent
Arredondo Rosales et al.

(10) Patent No.: US 10,435,259 B2
(45) Date of Patent: Oct. 8, 2019

(54) MEDIA HOLDDOWN SUCTION FORCE ADJUSTMENT

(71) Applicant: Hewlett-Packard Development Company, L.P., Houston, TX (US)

(72) Inventors: Alberto Arredondo Rosales, Barcelona (ES); Eduardo Martin Orue, Barcelona (ES); Pau Martin Vidal, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/753,394

(22) PCT Filed: Aug. 17, 2015

(86) PCT No.: PCT/EP2015/068859

§ 371 (c)(1),
(2) Date: Feb. 19, 2018

(87) PCT Pub. No.: WO2017/028900

PCT Pub. Date: Feb. 23, 2017

(65) Prior Publication Data

US 2018/0237242 A1 Aug. 23, 2018

(51) Int. Cl.
*B65H 5/22* (2006.01)
*B65H 7/16* (2006.01)
(Continued)

(52) U.S. Cl.
CPC ..... *B65H 5/222* (2013.01); *B41J 11/0085* (2013.01); *B41J 11/0095* (2013.01); *B41J 11/02* (2013.01); *B65H 7/02* (2013.01); *B65H 7/16* (2013.01); *B65H 11/00* (2013.01); *B65H 2406/3221* (2013.01);
(Continued)

(58) Field of Classification Search
CPC . B65H 5/222; B65H 7/02; B65H 7/04; B65H 7/16; B65H 7/20; B65H 11/00; B65H 11/005; B65H 2406/00; B65H 2406/30; B65H 2406/3221; B65H 2406/3222; B65H 2406/36; B65H 2406/3622; B65H 2406/363; B65H 2406/366; B65H 2515/342; B65H 2553/11
See application file for complete search history.

(56) References Cited

U.S. PATENT DOCUMENTS 5,634,636 A 6/1997 Jackson et al.
6,254,081 B1 7/2001 Rasmussen et al.
(Continued)

FOREIGN PATENT DOCUMENTS

CN 203048277 7/2013
CN 203998233 12/2014

*Primary Examiner* — Prasad V Gokhale

(74) *Attorney, Agent, or Firm* — HP Inc. Patent Department

(57) ABSTRACT

Examples described herein include devices and methods for adjusting a suction force for a media holddown, comprising detecting an advancement of a media (114) relative to a media holddown surface along a media advancement direction (X), wherein the holddown surface has a plurality of suction zones arranged along the media advancement direction, and adjusting a suction force in the respective suction zones in accordance with the advancement of the media relative to the media holddown surface.

16 Claims, 9 Drawing Sheets

(51) Int. Cl.

| | |
|---|---|
| ***B65H 11/00*** | (2006.01) |
| ***B65H 7/02*** | (2006.01) |
| ***B41J 11/00*** | (2006.01) |
| ***B41J 11/02*** | (2006.01) |

(52) U.S. Cl.

CPC ..... *B65H 2406/3222* (2013.01); *B65H 2406/363* (2013.01); *B65H 2406/366* (2013.01); *B65H 2406/3622* (2013.01); *B65H 2511/51* (2013.01); *B65H 2511/515* (2013.01); *B65H 2515/342* (2013.01); *B65H 2553/11* (2013.01); *B65H 2701/1311* (2013.01); *B65H 2701/1313* (2013.01); *B65H 2701/1315* (2013.01); *B65H 2801/12* (2013.01); *B65H 2801/15* (2013.01)

(56) References Cited

U.S. PATENT DOCUMENTS

| | | | | |
|---|---|---|---|---|
| 6,254,090 | B1 | 7/2001 | Rhodes et al. | |
| 6,543,948 | B2 | 4/2003 | Beehler et al. | |
| 6,637,960 | B2 | 10/2003 | Garcia et al. | |
| 7,980,558 | B2 * | 7/2011 | Moore | B41J 11/007 271/276 |
| 8,740,487 | B2 | 6/2014 | Kopel et al. | |
| 8,770,697 | B2 | 7/2014 | Wolanski et al. | |
| 8,967,792 | B2 | 3/2015 | Atwood et al. | |
| 2007/0090593 | A1 * | 4/2007 | McNally | B41J 13/226 271/276 |
| 2009/0057982 | A1 * | 3/2009 | Mitsuya | B65H 1/025 271/3.11 |
| 2010/0020150 | A1 * | 1/2010 | Love | B41J 11/003 347/104 |
| 2010/0141726 | A1 * | 6/2010 | Kawakami | B41J 11/0015 347/102 |
| 2014/0210155 | A1 * | 7/2014 | Satake | B41J 11/007 271/11 |
| 2017/0217219 | A1 * | 8/2017 | De Boer | B41J 11/0085 |
| 2018/0126756 | A1 * | 5/2018 | Gracia Verdugo | B41J 11/0085 |
| 2018/0305157 | A1 * | 10/2018 | Veis | B65G 21/2036 |

* cited by examiner

MEDIA HOLDDOWN SUCTION FORCE ADJUSTMENT

BACKGROUND

Large-format printers often comprise a platform, such as a platen positioned under the media path in the print zone area. The platen supports the media as the media is advanced from the media input through the print zone towards the media output, and assures its flatness and proper alignment. Transport means such as belts for advancing the media through the print zone may be incorporated into the platen.

In some platens, a vacuum suction force is applied to the underside of the printing media, such as by means of a plurality of suction ports that are provided on the platen and connected to a vacuum source, such as a pump or fan, via vacuum channels. The suction force applied to the underside of the printing media keeps the media in contact with the platen or belt and well-aligned during the whole printing process, and hence improves the throughput specifications.

DETAILED DESCRIPTION

Figure 1A:
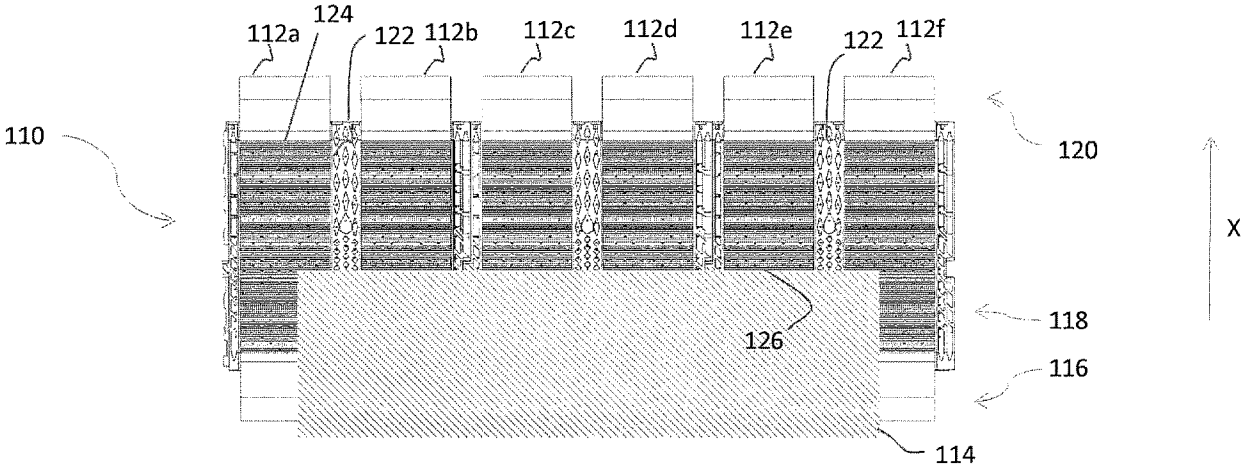
FIGS. 1*a* and 1*b* are top views of an example platen of a large-scale printing device with suction ports.

A method for adjusting a suction force for a media holddown comprises detecting an advancement of a media relative to a media holddown surface along a media advancement direction, wherein said holddown surface has a plurality of suction zones arranged along said media advancement direction, and adjusting a suction force in said respective suction zones in accordance with said advancement of said media relative to said media holddown surface.

By providing a media holddown surface, such as a platen, with a plurality of suction zones arranged along the media advancement direction, and adjusting the suction force in the respective suction zones in accordance with the movement of the media, the suction force may be dynamically adjusted in accordance with the advancement of the printing media relative to the media holddown surface.

A level of said suction force may be adjusted to increase a suction force in a suction zone once said suction zone is being covered, or is about to be covered by said media in accordance with said advancement of said media relative to said media holddown surface. In particular, aid suction force in said suction zone may be activated once said suction zone is being covered, or about to be covered by said media in accordance with said advancement of said media relative to said media holddown surface.

In such implementations, the suction force may be increased or activated in a particular suction zone of said media holddown surface only as or when said media reaches said particular suction zone. This allows the platen to straighten or position the leading edge of the media as it moves across the media holddown surface, and to avoid curling of the leading edge of the media.

In some implementations, said level of said suction force may be adjusted to reduce a suction force in a suction zone once said suction zone is being uncovered, or about to be uncovered by said media in accordance with said advancement of said media relative to said media holddown surface. In particular, said suction force may be deactivated in a suction zone once said suction zone is being uncovered, or about to be uncovered by said media in accordance with said advancement of said media relative to said media holddown surface. This allows implementations of the present disclosure to reduce or deactivate the suction force in those areas of the media holddown surface that the media has already passed, and hence helps avoids a loss of vacuum in those areas of the media holddown surface where a suction force is no longer needed. The suction force may instead be concentrated in those areas of the media holddown surface that are still being covered by said media, or are about to be covered by said media.

However, adjusting the level of the suction force in a given suction zone is not the only possible way of adjusting said suction force. In some implementations, adjusting said suction force in said respective suction zones comprises adjusting a size of a suction zone, in particular increasing or decreasing a size of a suction zone in accordance with said advancement of said media relative to said media holddown surface.

As a result, the suction force may be tailored and dynamically adjusted to those suction zones that are currently occupied or covered by the media, and a waste of vacuum in other parts of the media holddown surface is avoided. In this way, the suction force can be concentrated on a given media, and hence can be applied more efficiently.

A suction force, in the sense of the present disclosure may be understood to denote a pressure force that attracts said media to said media holddown surface. In particular, said suction force may be applied to an underside of said media.

The suction force may be induced by means of a vacuum source, and in this case may be referred to as a vacuum-induced force or, in short, vacuum force.

A suction force or vacuum force may be characterized in terms of a pressure that is locally decreased with respect to a pressure in a surrounding environment, in particular, locally decreased with respect to an atmospheric pressure.

A media, in the sense of the present disclosure, may be a flexible media, such as a flexible sheet.

In particular, said media may be a printing media, and/or said media holddown surface may be located in a printing device.

Examples of printing media include paper, cardboard, or plastic materials.

A suction zone may comprise part of said media holddown surface.

Example methods of the present disclosure may further comprise detecting said advancement of said media relative to said media holddown surface, and adjusting said suction force in accordance with said detected advancement of said media relative to said media holddown surface.

Detection of said advancement of said media relative to said media holddown surface allows implementations of the present disclosure to carefully tailor the application of the suction force in accordance with said advancement of said media relative to said media holddown surface.

Said advancement of said media may be detected by means of a sensor, in particular by means of an optical sensor and/or a capacitive sensor and/or a pressure sensor.

In particular, detecting said advancement of said media relative to said media holddown surface may comprise detecting a pressure change as said media covers or uncovers a pressure trigger port located in said media holddown surface.

By means of pressure trigger ports located in said media holddown surface, the advancement of said media may be detected as a decrease or an increase in pressure, as said media covers or uncovers said pressure trigger port. This allows implementations of the present disclosure to reliably detect an advancement of said media. Moreover, said increase or decrease in pressure may be employed to automatically adjust said suction force applied to said respective suction zones. In particular, said pressure change may actuate a vacuum valve for channeling a suction force to selected suction zones in accordance with said advancement of said media relative to said media holddown surface.

In an example, said suction force is provided by a vacuum source that is selectively connectable to said plurality of suction zones, and adjusting said suction force comprises a step of selectively connecting said vacuum source to said suction zones in accordance with said advancement of said media relative to said media holddown surface.

Said suction zones may be separated by at least one vacuum valve, and adjusting said suction force may comprise a step of controlling said vacuum valve in accordance with said advancement of said media relative to said media holddown surface.

In some implementations, said suction force may be provided by means of a plurality of vacuum sources associated with and in fluid communication with said plurality of respective suction zones, and adjusting said suction force may comprise a step of selectively controlling said plurality of vacuum sources in accordance with said advancement of said media relative to said media holddown surface. In particular, said plurality of vacuum sources may be activated and deactivated to respectively increase or reduce a corresponding suction force in the corresponding suction zone in accordance with said advancement of said media relative to said media holddown surface.

An apparatus for adjusting a suction force may comprise a transport unit that advances a media along a media advancement direction, wherein said transport unit comprises a media holddown surface with a plurality of suction zones arranged along said media advancement direction. The apparatus may further comprise a vacuum source that applies a suction force to said suction zones, wherein said apparatus adjusts a level of said suction force applied to said suction zones in accordance with said advancement of said media relative to said media holddown surface.

Said suction zones may be provided with a plurality of suction ports in fluid communication with said vacuum source, wherein said suction force may be applied to said media, in particular to an underside of said media, through said suction ports.

In an example, said apparatus increases a suction force in a suction zone once said suction zone is being covered, or about to be covered by said media in accordance with said advancement of said media relative to said media holddown surface. In particular, said apparatus may activate a suction force in a suction zone once said suction zone is being covered, or about to be covered by said media in accordance with said advancement of said media relative to said media holddown surface.

In some implementations, said apparatus may reduce a suction force in a suction zone once said suction zone is being uncovered, or about to be uncovered by said media in accordance with said advancement of said media relative to said media holddown surface. In particular, said apparatus may deactivate a suction force in a suction zone once said suction zone is being uncovered, or about to be uncovered by said media in accordance with said advancement of said media relative to said media holddown surface.

Said apparatus may comprise a control unit that adjusts said level of said suction force applied to said suction zones in accordance with said advancement of said media relative to said media holddown surface.

Said control unit may be an electronic control unit, or a mechanically actuated or pressure-actuated control unit.

Said apparatus may comprise a sensor unit that detects said advancement of said media relative to said media holddown surface, wherein said apparatus adjusts said level of said suction force in accordance with said detected advancement of said media relative to said media holddown surface.

Said sensor unit may comprise a pressure sensor and/or an optical sensor and/or a capacitive sensor.

In particular, said sensor unit may comprise at least one pressure trigger port located in said media holddown surface, wherein said pressure trigger port detects a pressure change as said media covers or uncovers said pressure trigger port.

In an example, said suction zones may be separated by at least one vacuum valve, and said apparatus may adjust said level of said suction force by controlling said vacuum valve in accordance with said advancement of said media relative to said media holddown surface.

In particular, said apparatus may comprise a pressure trigger port located in said media holddown surface, wherein said at least one vacuum valve may be in fluid communication with said pressure trigger port.

In an example, said apparatus comprises a plurality of vacuum sources associated with and in fluid communication with said plurality of respective suction zones, wherein said apparatus adjusts said level of said suction force by selectively controlling said plurality of vacuum sources in accordance with said advancement of said media relative to said media holddown surface.

Said apparatus may be or may comprise a printing device, in particular a large-scale printing device.

The disclosure further relates to a computer-readable program comprising computer-readable instructions, such that said instructions, when executed by a computer, implement a method with some or all of the steps described above.

The disclosure further relates to a computer-readable medium comprising computer-readable instructions, such that said instructions, when read on said computer, implement a method with some or all of the steps described above.

Examples of methods and apparatuses for adjusting a suction force for a media holddown will now be described in greater detail with reference to FIGS. 1 to 8.

These examples relate to the suction force adjustment for a media holddown in a large-format printing device, such as a large-format inkjet printing device. The printing media in this case may be a sheet of paper or cardboard. However, the disclosure is not so limited, and generally applies to any apparatus in which media is held to a media holddown surface by means of a suction force while being advanced along a media advancement direction.

Figure 1B:
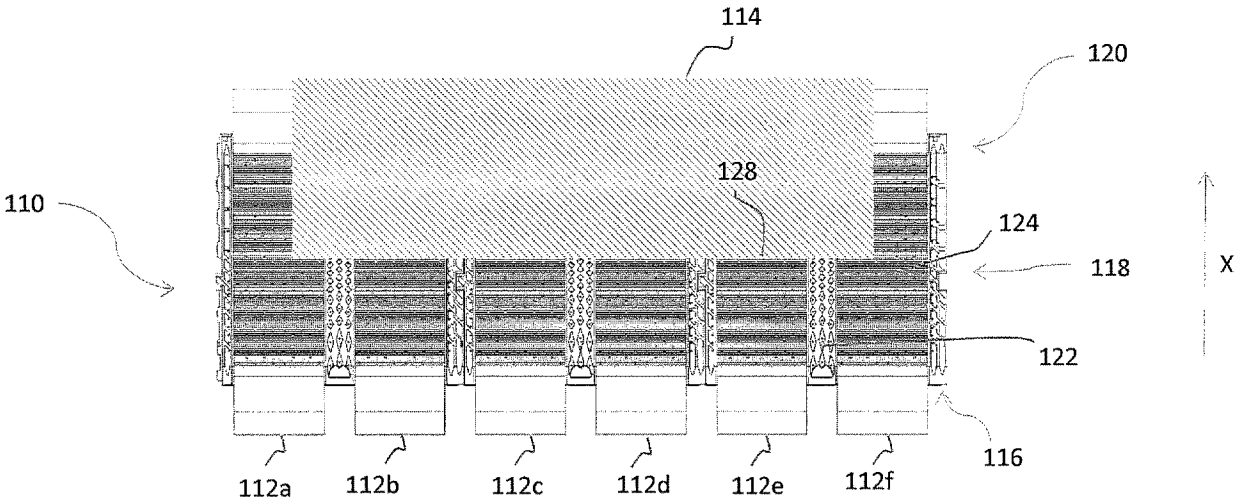

FIGS. 1*a* and 1*b* are top views of a platen 110 of a large-format printing device.

The platen 110 comprises a plurality of transportation belts 112*a* to 112*f* that transport a printing media 114, such as a sheet of paper from a media input zone 116 through a print zone 118 to a media output zone 120 along a media advancement direction x (indicated by an arrow in FIG. 1*a*). The printing media 114 is inserted and brought into contact with the surface of the platen 110 in the media input zone 116. The transportation belts 112*a* to 112*f* transport the media 114 to the print zone 118, where print heads print on the upper side of the printing media 114. The print heads are located above the platen 110 and the printing media 114 in the print zone 118, but are not shown in FIG. 1*a* so to streamline the presentation. After the printing, the printing media 114 is advanced to the media output zone 120 and output from the printing device.

As shown in Fig. la, the upper surface of the platen 110 is provided with a plurality of suction ports 122 in the form of small holes distributed evenly across the entire platen 110. The suction ports 122 are in fluid communication with a vacuum chamber (not shown in FIG. 1*a*) located underneath the platen 110. A vacuum source such as a fan or pump (not shown) is located in or in fluid communication with the vacuum chamber and establishes a vacuum in the vacuum chamber. A vacuum, in the sense of the disclosure, may be characterized in terms of a reduced pressure with respect to the pressure in the surrounding environment, such as with respect to an atmospheric pressure. Due to the fluid communication with the suction ports 122, the vacuum in the vacuum chamber applies a suction force to the underside of the printing media 114 on the platen 110.

The transportation belts 112*a* to 112*f* on the surface of the platen 110 may likewise be provided with little holes or openings 124 that allow air to pass through and hence facilitate the application of the suction force to the underside of the printing media 114.

Due to the suction force, the media 114 is tightly held and can be accurately positioned on the transportation belts 112*a* to 112*f* while being advanced along the media advancement direction x. In particular, the suction force avoids curling of the media 114, which could lead to media jams or degrade the printing quality.

Good results can be obtained with the vacuum holddown in case the media covers the entire platen. However, problems sometimes occur with smaller printing media that only partially cover the platen, so that some of the suction ports remain uncovered. Vacuum is lost through the uncovered suction ports, and the decrease in the suction force may lead to curling of the printing media, in particular at the leading and trailing edges of the printing media. These problems may lead to media jams as well to inaccuracies in the positioning of the printing media on the platen and insufficient control of the distance between the printing media and the print head, which may have significant impact on the printing quality.

In case the printing media 114 does not fully cover the platen 110, some of the suction ports 122 of the platen 110 and the openings 124 formed in the transportation belts 112*a* to 112*f* remain uncovered. This also happens in configurations in which the printing media 114 has only been partially inserted into the printing device with its leading edge 126, as shown in Fig. la. Similarly, there may be many uncovered suction ports 122 and openings 124 when the media 114 has already been partially removed from the printing device, and only its trailing edge 128 remains on the platen 110, as schematically shown in FIG. 1*b*.

Uncovered suction ports 122 and openings 124 are not only ineffective for exerting a suction force on the media 114. What is worse, vacuum from the vacuum chamber escapes through the uncovered suction ports 122 and openings 124, and hence reduces the suction force applied to the underside of the medium 114 even through those suction ports 122 and openings 124 that are still covered by the media 114.

The reduced suction force may lead to undesired curling of the leading edge 126 and trailing edge 128 of the printing media 114. One solution to such problems can be addressed with a stronger vacuum source that applies a stronger suction force sufficient to avoid the undesired curling even in configurations in which the printing media 114 only partially covers the platen 110. However, a stronger vacuum force increases the energy consumption, and at the same time leads to undesired noise during operation.

In a configuration according to the present disclosure, the level of the suction force can be adjusted in accordance with an advancement of the printing media across the platen. This may be achieved by detecting an advancement of the media 114 across the platen 110, and selectively activating or deactivating the respective suction ports 122 in accordance with the advancement of the media 114 across the platen 110.

For instance, in the configuration of FIG. 1*a* in which the printing media 114 has only been partially inserted into the printing device with its leading edge 126, the suction ports 122 that are not yet covered (hence, the suction ports 122 in the upper portion of the platen 110 in the representation of Fig. la) may be deactivated. By activating only the suction ports 122 underneath the media 114, a loss of vacuum may be avoided.

Similarly, in the configuration of FIG. 1*b* in which the media 114 has already been partially removed from the printing device, and only its trailing edge 128 remains on the platen 110, the suction ports 122 that are no longer covered by the media 114 (hence, the suction ports 122 in the lower portion of the platen 110 in representation of FIG. 1*b*) may be selectively deactivated, so as to concentrate the suction force on those suction ports 122 that are still being covered by the media 114.

A selected suction port 122 may be activated by establishing a fluid communication between said suction port and said vacuum source, such as by opening a vacuum valve. Conversely, a suction port 122 may be deactivated by closing a fluid communication between said suction port 122 and said vacuum source, such as by closing a vacuum valve.

Figure 2:
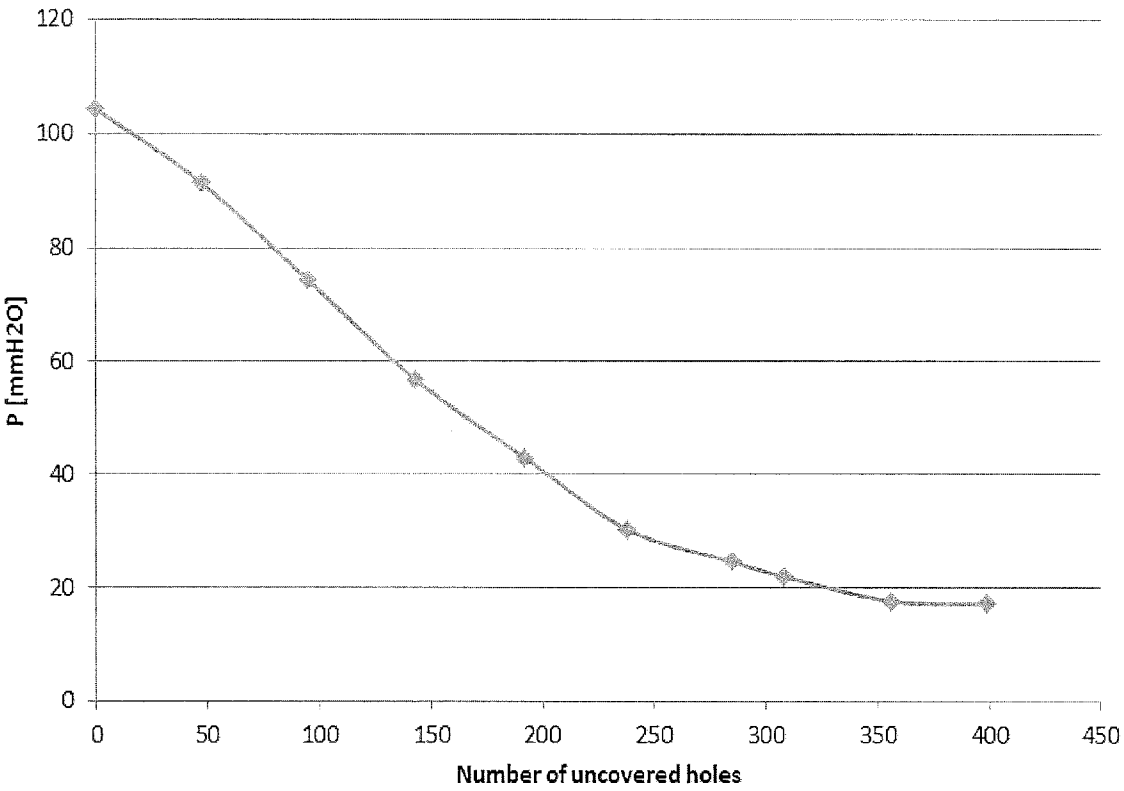
FIG. 2 is a diagram that shows an example decrease in suction force depending on the number of uncovered suction ports.

FIG. 2 is a diagram that shows experimental data to illustrate the effect and advantages that can be achieved by selectively activating or deactivating suction ports 122 in accordance with said advancement of said media 114 relative to the platen 110. FIG. 2 represents measurements with a platen 110 with 400 suction ports 122 evenly distributed across the surface of the platen 110 and illustrates the decrease in suction pressure P (suction force divided by unit suction area) as uncovered suction ports 122 are progressively activated. As can be taken from FIG. 2, the decrease in the suction pressure as the number of uncovered suction ports 122 grows is rather pronounced. For instance, the suction pressure P is reduced to approximately 30% of its maximum value if only half of the suction ports 122 are uncovered. Conversely, by selectively deactivating those suction ports 122 on the platen 110 that are currently not being covered by the media 114, the suction pressure P can be significantly increased, and hence the throughput specifications can be improved.

Another example of an implementation of a suction force adjustment will now be described with reference to FIGS. 3 to 7.

Figure 3:
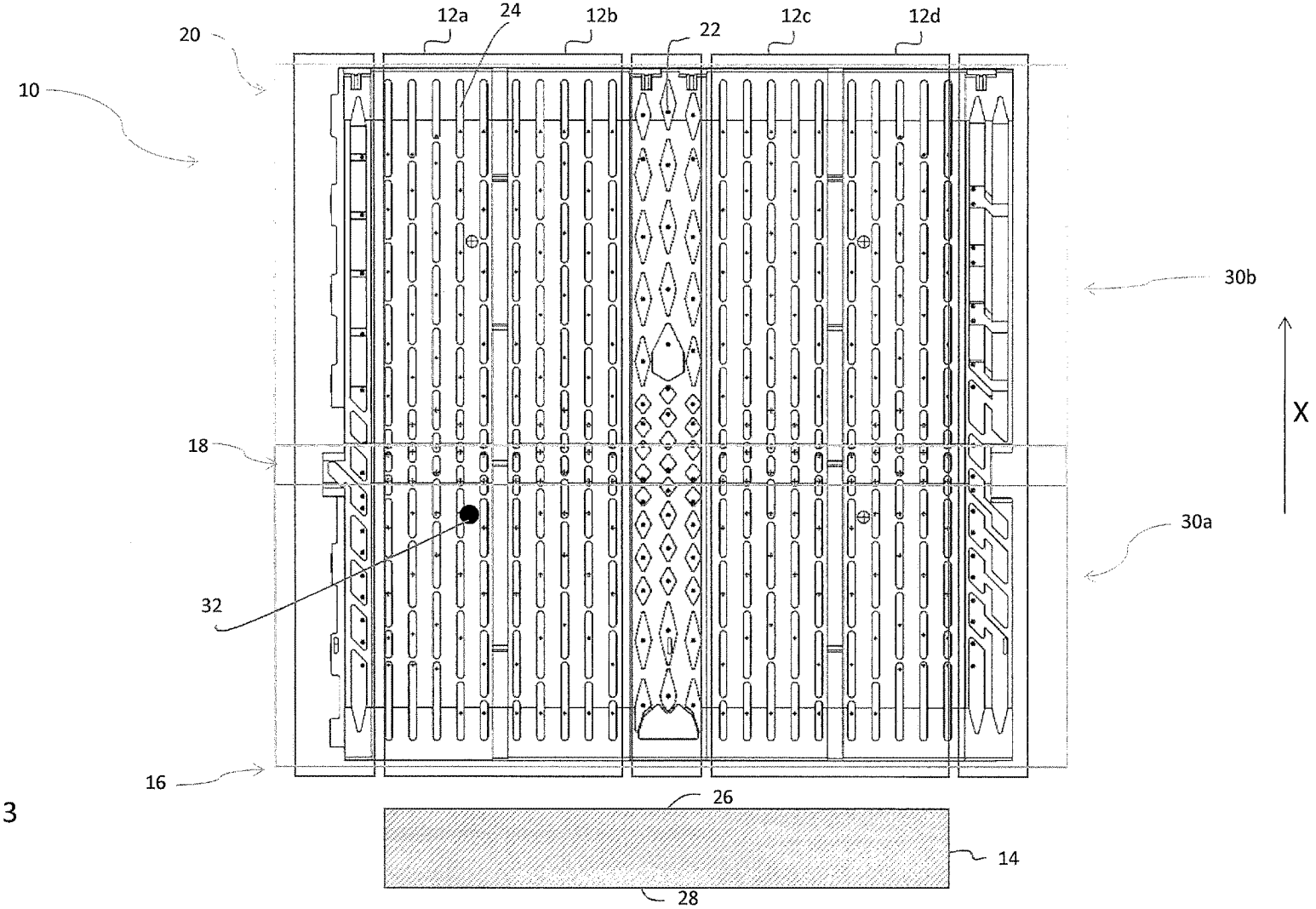
FIG. 3 is a schematic top view of an example media holddown surface.

FIG. 3 is a schematic top view of a platen 10 that generally corresponds to the platen 110 described above with reference to FIGS. 1*a* and 1*b*. In particular, the platen 10 comprises a plurality of transportation belts 12*a* to 12*d* adapted to transport a printing media 14, such as a sheet of paper across the platen 10 from a media input zone 16 across a print zone 18 to a media output zone 20 along the media advancement direction x. As shown in reference to platen 110, platen 10 shown in FIG. 3 can include a plurality of suction ports 22 and a plurality of openings 24 formed in the transportation belts 12*a* to 12*d* The suction ports 22 can be in fluid communication with an underlying vacuum chamber and apply a suction force to the underside of the printing media 14, partially mediated through the openings 24 formed in the transportation belts 12*a* to 12*d*.

Platen 10 shown in FIG. 3 can be subdivided into a first suction zone 30*a* that extends from the media input zone 16 to the print zone 18, and a second suction zone 30*b* that extends from the print zone 18 to the media output zone 20. In the configuration of FIG. 3, the vacuum force applied to the printing media 14 in the first suction zone 30*a* and in the second suction zone 30*b* may be individually controlled to adjust the level of the suction force and to activate or deactivate the suction force dynamically in accordance with the advancement of the printing media 14 relative to the platen 10.

In particular, as the printing media 14 is inserted into the printing device with its leading edge 26 in the media input zone 16, only the first suction zone 30*a* may be activated, whereas the second suction zone 30*b* may be or remain deactivated. Hence, when the printing media 14 is transported from the media input zone 16 to the print zone 18, a suction force is applied to its underside in the first suction zone 30*a*, as described above with reference to FIGS. 1*a* and 1*b*. However, the suction ports 22 located beyond the print zone 18 in the second suction zone 30*b* are not yet covered by the media 14, and may hence be deactivated in order to avoid a loss of vacuum.

Conversely, once the printing media 14 has fully passed the print zone 18 and proceeds towards the media output zone 20, it only covers the suction ports 22 in the second suction zone 30*b*, whereas the suction ports 22 in the first suction zone 30*a* are uncovered. In this configuration, the suction force applied to the second suction zone 30*b* may be activated or increased to allow for an advancement of the printing media 14 towards the media output zone 20 without curling, whereas the suction force in the first suction zone 30*a* may be deactivated or reduced to avoid a loss of vacuum through the uncovered suction ports 22 in the first suction zone 30*a*.

A sensor may be employed to detect the advancement of the printing media 14 across a platen 10 and to adjust the level of the suction force in the first suction zone 30*a* and in the second suction zone 30*b* accordingly. The sensor may comprise a pressure sensor and/or an optical sensor and/or a capacitive sensor to detect the advancement of the printing media 14.

In the configuration of FIG. 3, a pressure sensor with a pressure trigger port 32 is located in the first suction zone 30*a* in the surface of the platen 10 and is employed to sense the advancement of the printing media 14, as will now be described in greater detail with reference to FIGS. 4*a* and 5.

Figure 4A:
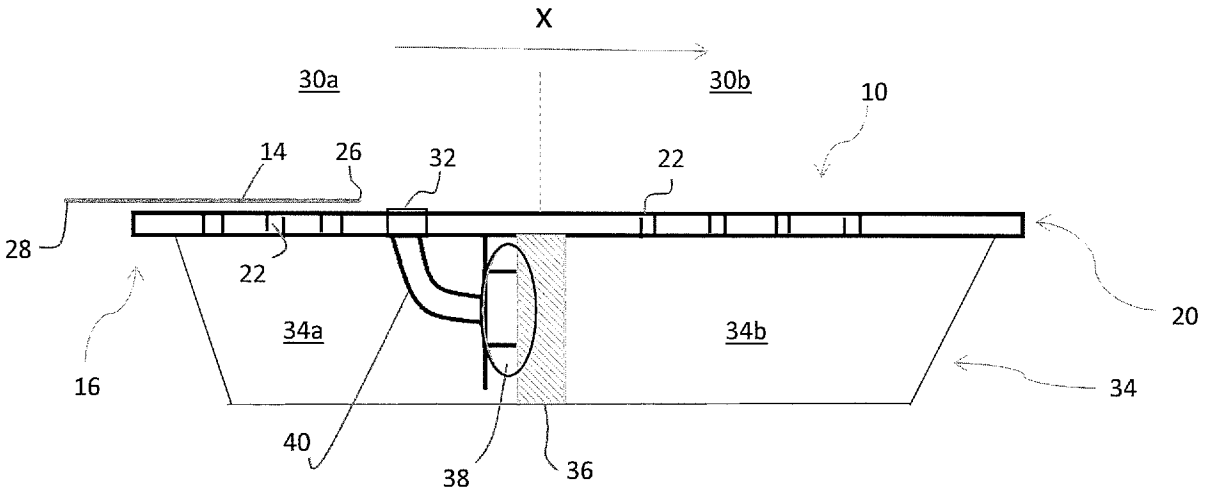
FIG. 4*a* is a schematic side view of an example apparatus for adjusting a suction force.
Figure 4B:
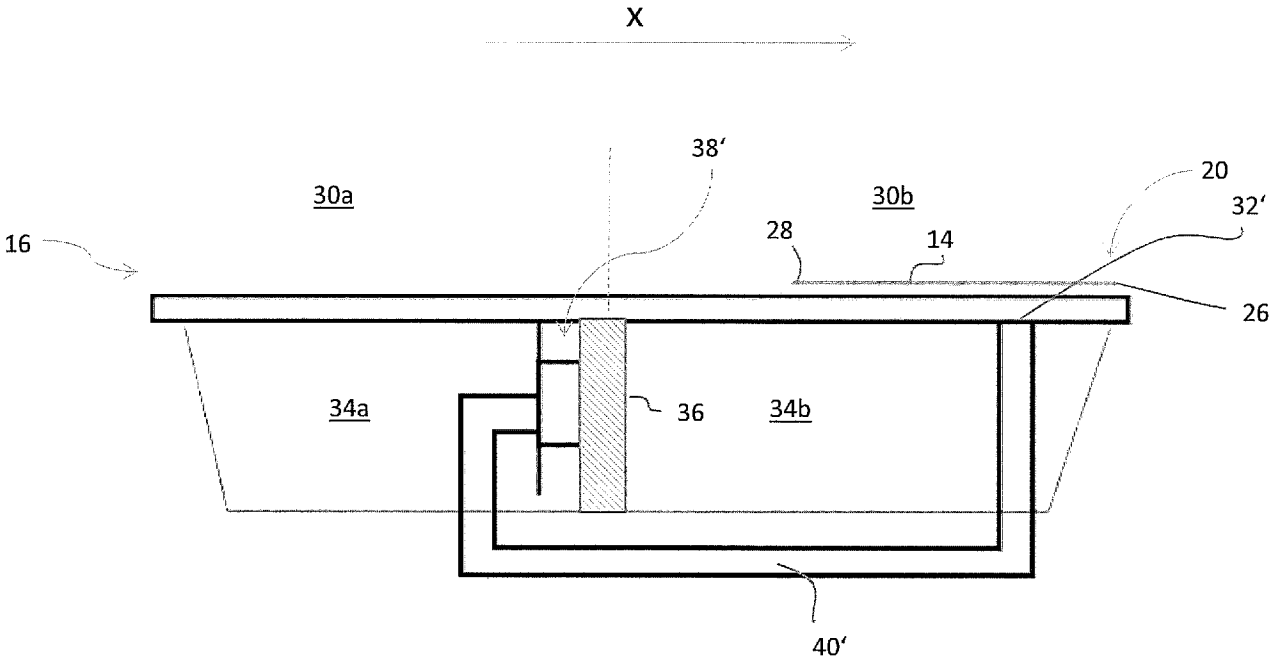
FIG. 4*b* is a schematic side view of another example apparatus for adjusting a suction force.

FIG. 4*a* is a schematic side view of the apparatus for adjusting a suction force illustrated in FIG. 3, and in particular shows the vacuum chamber 34 that is formed underneath the platen 10 and is in fluid communication with the first suction zone 30*a* of the platen 10 and the second suction zone 30*b* of the platen 10 through the plurality of suction ports 22. The vacuum chamber 34 can be partially evacuated by means of a fan or pump (not shown) to reduce the pressure in the vacuum chamber 34 with respect to the atmospheric pressure in the surrounding environment.

As shown in FIG. 4*a*, the vacuum chamber 34 is subdivided into a first sub-chamber 34*a* in fluid communication with the first suction zone 30*a*, and a second sub-chamber 34*b* in fluid communication with the second suction zone 30*b*. The second sub-chamber 34*b* is separated from the first sub-chamber 34*a* by means of a separation wall 36 in which a valve, such as a vacuum valve 38 is provided. The vacuum valve 38 is in fluid communication with the pressure trigger port 32 by means of a vacuum duct 40.

Figure 5:
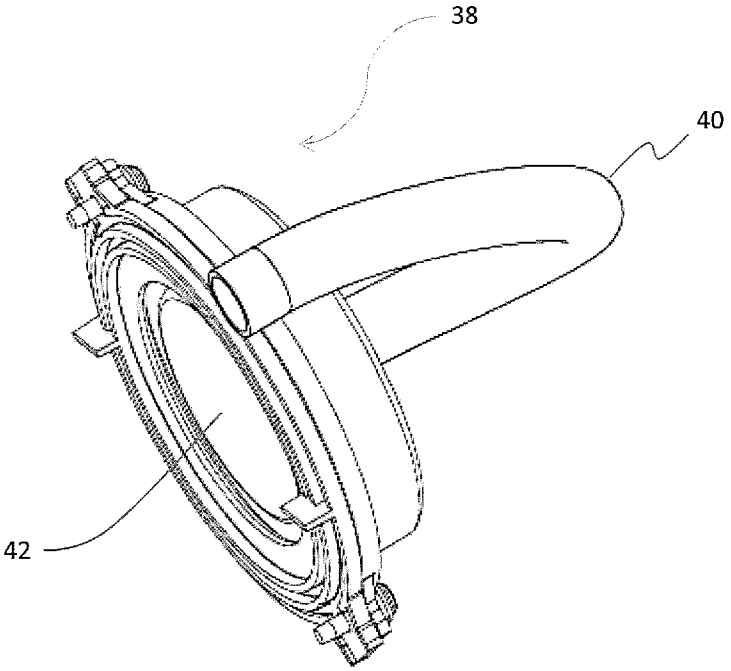
FIG. 5 is a perspective view of an example air supply valve that may be employed in an apparatus for adjusting a suction force.

A perspective schematic view of the vacuum valve 38 is shown in FIG. 5. The vacuum valve 38 comprises a diaphragm 42 that can be moved back and forth in response to the pressure applied from the pressure trigger port 32 via the vacuum duct 40 to selectively open and close the valve and establish or impede fluid communication between the first sub-chamber 34*a* and the second sub-chamber 34*b* of the vacuum chamber 34.

Figure 6B:
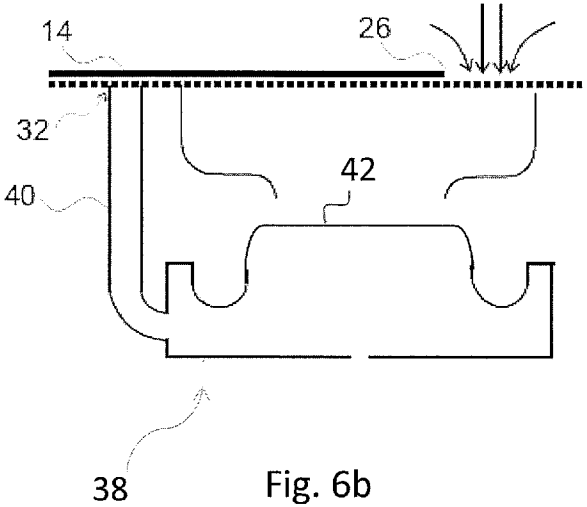
FIGS. 6*a* and 6*b* are schematic diagrams that illustrate an example operation of an air supply valve in a closed valve configuration (FIG. 6*a*) and in an open valve configuration (FIG. 6*b*), respectively.
Figure 6A:
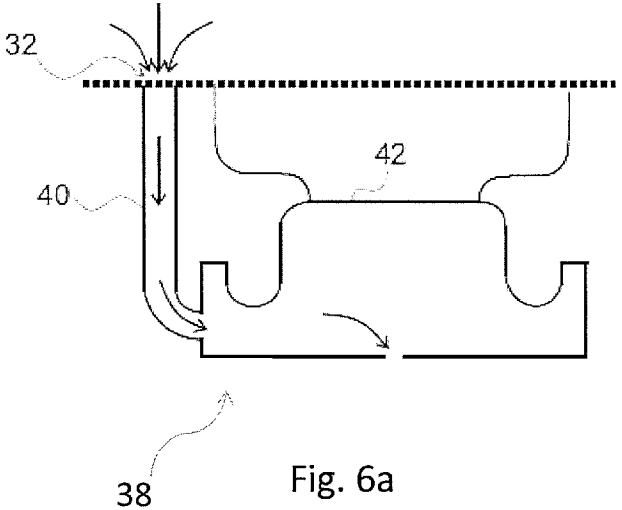

The operation of the vacuum valve 38 is illustrated schematically in FIGS. 6*a* and 6*b*.

FIG. 6*a* shows a closed valve configuration in which the pressure trigger port 32 is uncovered and the diaphragm 42 impedes the fluid communication between the first sub-chamber 34*a* and the second sub-chamber 34*b*. A suction force may hence be established in the first suction zone 30*a* by means of the vacuum in the first sub-chamber 34*a*, whereas the second sub-chamber 34*b* is under atmospheric pressure and no suction force is applied to the second suction zone 30*b*.

As the media 14 advances across the platen 10 towards the print zone 18, the leading edge 26 of the media will eventually cover the pressure trigger port 32. If that happens, a vacuum is established in a sensing chamber connected to the pressure trigger port 32, which leads to a relaxation of the diaphragm 42, as illustrated schematically in FIG. 6*b*. In this configuration, the vacuum valve 38 establishes a fluid communication between the first sub-chamber 34*a* and the second sub-chamber 34*b*, and a vacuum will be established in the second sub-chamber 34*b* and will apply a suction force to the second suction zone 30*b*, in accordance with the advancement of the media 14 across the platen 10.

When the printing media 14 is advanced even further across the platen 10 towards the media output zone 20, at some point the trailing edge 28 of the printing media 14 will no longer cover the pressure trigger port 32, and the vacuum valve 38 would revert to the closed configuration of FIG. 6*a*, with the consequence that the suction force in the second suction zone 30*b* would be deactivated. In order to avoid the deactivation of the suction force in the second suction zone 30*b*, a second valve 38' may be provided in the separation wall 36 in parallel to the first vacuum valve 38, as shown schematically in the side view of FIG. 4*b*. The second vacuum valve 38' fully corresponds in design and functionality to the first vacuum valve 38, with the only distinction that it is connected by means of the vacuum duct 40' to a second pressure trigger port 32' located in the surface of the platen 10 in the second suction zone 30*b*. Once the media advances through the second suction zone 30*b* towards the media output zone 20, the second pressure trigger port 32 located in the second suction zone 30*b* will be covered, and hence the vacuum valve 38' will be in the open configuration of FIG. 6*b*, thereby maintaining the fluid communication between the first sub-chamber 34*a* and the second sub-chamber 34*b*.

Figure 7:
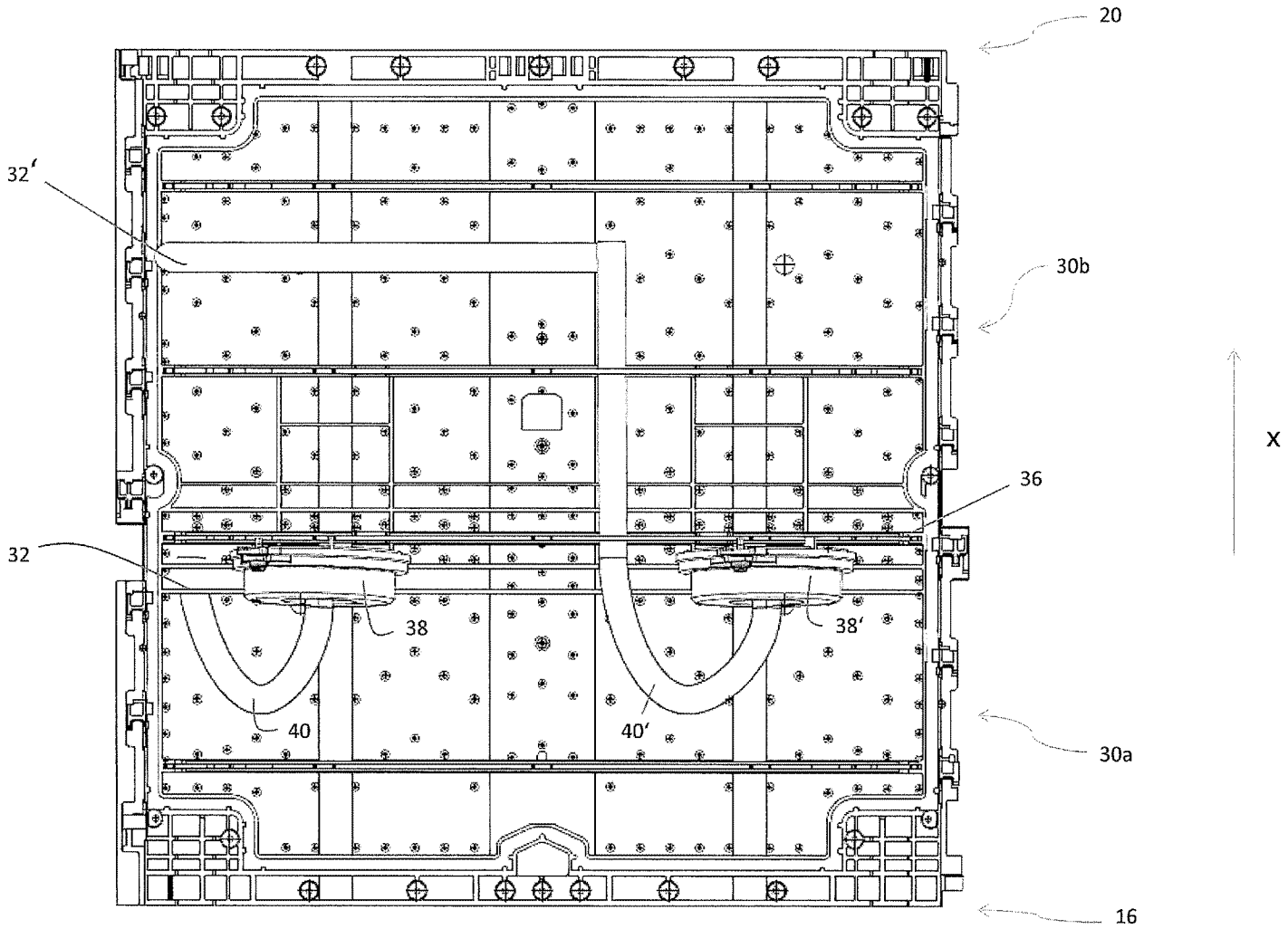
FIG. 7 is a schematic bottom view of an example media holddown surface employing two air supply valves.

FIG. 7 is a schematic bottom view of the platen 10 that shows the two valves 38, 38' that are connected via respective vacuum ducts 40, 40' to the pressure trigger ports 32, 32' located in the first suction zone 30*a* and the second suction zone 30*b*, respectively.

Figure 8:
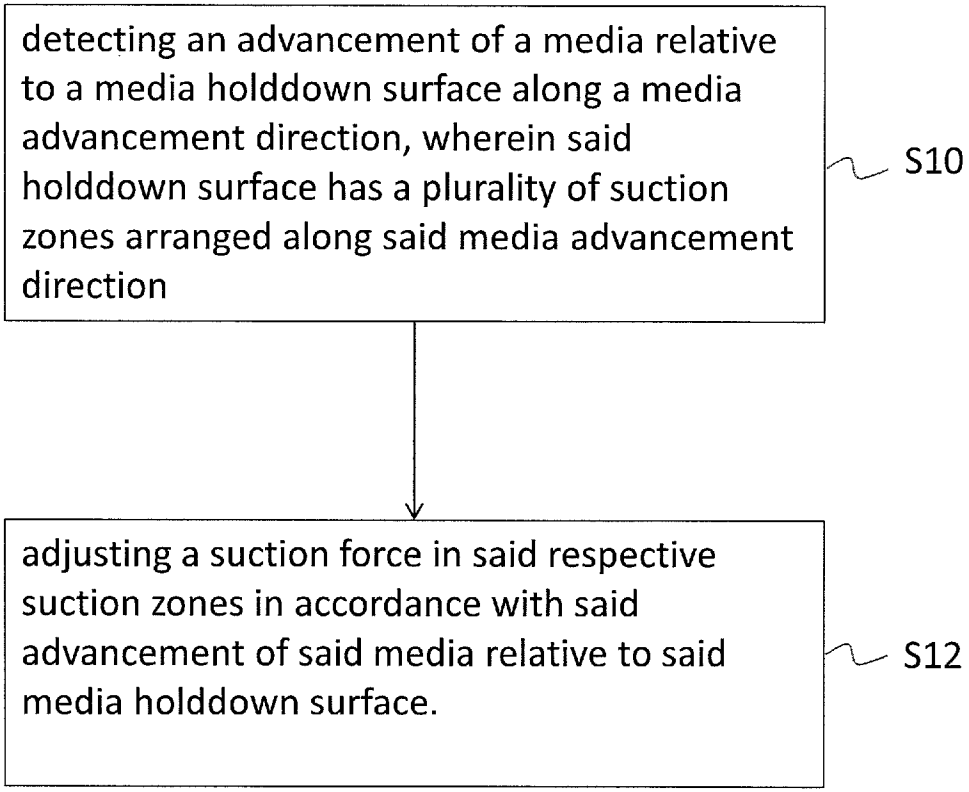
FIG. 8 is a flow diagram that illustrates an example method for adjusting a suction force for a media holddown.

FIG. 8 is a flow diagram that illustrates a method for adjusting a suction force for a media holddown. In a first step S10, an advancement of a media relative to a media holddown surface along a media advancement direction is detected, wherein said holddown surface has a plurality of suction zones arranged along said media advancement direction.

In a second step S12, a suction force in said respective suction zones is adjusted in accordance with said advancement of said media relative to said media holddown surface.

The description of the specific implementations and the Figures merely serve to illustrate the disclosure, but should not be understood to limit the disclosure. The scope of the disclosure is to be determined solely by means of the appended claims.

The invention claimed is:

1. A method for adjusting a suction force for a media holddown, comprising:

detecting an advancement of a media relative to a media holddown surface along a media advancement direction, wherein said holddown surface has a plurality of suction zones arranged along said media advancement direction; and adjusting the suction force in said respective suction zones in accordance with said advancement of said media relative to said media holddown surface, wherein adjusting said suction force comprises:

activating a first suction force in a first suction zone of said plurality of suction zones in response to said first suction zone being covered by said media or said first suction zone being about to be covered by said media due to advancement of said media along said media advancement direction, wherein said first suction zone is in fluid communication with a first chamber and activating said first suction force in said first suction zone comprises applying a vacuum to said first chamber; and after said activating said first suction force in said first suction zone, activating a second suction force in a second suction zone of said plurality of suction zones in response to said second suction zone being covered by said media or said second suction zone being about to be covered by said media, wherein said second suction zone is in fluid communication with a second chamber separated by a wall from said first chamber and is located at a position along said media advancement direction beyond a position of said first suction zone, and activating said second suction force in said second suction zone comprises opening a first valve to establish fluid communication through said wall between said first chamber and said second chamber.

2. The method according to claim 1, further comprising deactivating the first suction force in the first suction zone in accordance with said advancement of said media along said media advancement direction.

3. The method according to claim 1, further comprising increasing or decreasing a size of the first suction zone in accordance with said advancement of said media along said media advancement direction.

4. The method according to claim 1, wherein detecting said advancement of said media along said media advancement direction comprises detecting a pressure change as said media covers or uncovers a pressure trigger port located in said media holddown surface.

5. The method according to claim 1, wherein said first and second suction forces in said first and second suction zones are provided by a vacuum source that is selectively connectable to said first and second suction zones, and adjusting said suction force further comprises selectively connecting said vacuum source to said first and second suction zones in accordance with said advancement of said media along said media advancement direction.

6. The method according to claim 5, wherein said first valve comprises a vacuum valve, and activating said second suction force in said second suction zone comprises controlling said vacuum valve in accordance with said advancement of said media along said media advancement direction.

7. The method according to claim 1, wherein adjusting said suction force comprises selectively controlling a plurality of vacuum sources in accordance with said advancement of said media along said media advancement direction.

8. The method according to claim 1, wherein opening said first valve comprises opening said first valve in response to said media covering a first pressure trigger port.

9. The method according to claim 8, wherein said advancement of said media along said media advancement direction uncovers said first pressure trigger port, the method further comprising:

maintaining activation of said second suction force in said second suction zone, wherein said maintaining comprises opening a second valve to establish fluid communication through said wall in response to said media covering a second pressure trigger port.

10. An apparatus for adjusting a suction force for a media holddown, comprising:

a transport unit to advance a media along a media advancement direction, wherein said transport unit comprises a media holddown surface with a plurality of suction zones arranged along said media advancement direction; and at least one vacuum source in fluid communication with at least one of said plurality of suction zones to adjust the suction force in said suction zones in accordance with said advancement of said media relative to said media holddown surface, wherein said at least one vacuum source is to:

activate a first suction force in a first suction zone of said plurality of suction zones in response to said first suction zone being covered by said media or said first suction zone being about to be covered by said media due to advancement of said media along said media advancement direction, wherein said first suction zone is in fluid communication with a first chamber and activating said first suction force in said first suction zone comprises applying a vacuum to said first chamber; and after said activation of said first suction force in said first suction zone, activate a second suction force in a second suction zone of said plurality of suction zones in response to said second suction zone being covered by said media or said second suction zone being about to be covered by said media, wherein said second suction zone is in fluid communication with a second chamber separated by a wall from said first chamber and is located at a position along said media advancement direction beyond a position of said first suction zone, and activating said second suction force in said second suction zone comprises opening a first valve to establish fluid communication through said wall between said first chamber and said second chamber.

11. The apparatus according to claim 10, further comprising a sensor port to detect said advancement of said media along said media advancement direction.

12. The apparatus according to claim 11, wherein said sensor port comprises a pressure trigger port located in said media holddown surface.

13. The apparatus according to claim 10, wherein said first valve comprises a vacuum valve, said vacuum valve being controllable in accordance with said advancement of said media along said media advancement direction.

14. The apparatus according to claim 13, further comprising a pressure trigger port located in said media holddown surface, wherein said at least one vacuum valve is in fluid communication with said pressure trigger port.

15. The apparatus according to claim 10, further comprising a plurality of vacuum sources in fluid communication with said plurality of suction zones, said plurality of vacuum sources selectively controllable to adjust said first and second suction forces in said plurality of suction zones in accordance with said advancement of said media along said media advancement direction.

16. A computer-readable medium comprising computer-readable instructions, such that said instructions, when executed by a computer, cause said computer to:

detect an advancement of a media relative to a media holddown surface along a media advancement direction, wherein said holddown surface has a plurality of suction zones arranged along said media advancement direction; and adjust a level of a suction force in said respective suction zones in accordance with said advancement of said media relative to said media holddown surface, in particular activating or deactivating said suction force in at least one of said suction zones in accordance with said advancement of said media relative to said media holddown surface, wherein adjusting said suction force comprises:

activating a first suction force in a first suction zone of said plurality of suction zones in response to said first suction zone being covered by said media or said first suction zone being about to be covered by said media due to advancement of said media along said media advancement direction, wherein said first suction zone is in fluid communication with a first chamber and activating said first suction force in said first suction zone comprises applying a vacuum to said first chamber; and after said activating said first suction force in said first suction zone, activating a second suction force in a second suction zone of said plurality of suction zones in response to said second suction zone being covered by said media or said second suction zone being about to be covered by said media, wherein said second suction zone is in fluid communication with a second chamber separated by a wall from said first chamber and is located at a position along said media advancement direction beyond a position of said first suction zone, and activating said second suction force in said second suction zone comprises opening a first valve to establish fluid communication through said wall between said first chamber and said second chamber.

* * * * *